United States Patent [19]

Howell

[11] Patent Number: 4,631,621

[45] Date of Patent: Dec. 23, 1986

[54] GATE TURN-OFF CONTROL CIRCUIT FOR A SOLID STATE CIRCUIT INTERRUPTER

[75] Inventor: Edward K. Howell, Simsbury, Conn.

[73] Assignee: General Electric Company, New York, N.Y.

[21] Appl. No.: 754,032

[22] Filed: Jul. 11, 1985

[51] Int. Cl.[4] ..... H01H 9/42

[52] U.S. Cl. ..... 361/13; 361/11; 361/8; 361/56

[58] Field of Search ..... 361/3, 5, 8, 13, 56, 361/11; 307/252 C

[56] References Cited

U.S. PATENT DOCUMENTS

| | | | |
|---|---|---|---|
| 3,588,605 | 6/1971 | Casson | 361/13 |
| 3,783,305 | 1/1974 | Lefferts | 307/136 |
| 4,001,742 | 1/1977 | Howell | 335/173 |
| 4,115,829 | 9/1978 | Howell | 361/42 |
| 4,389,691 | 6/1983 | Hancock | 361/13 X |
| 4,438,472 | 3/1984 | Woodworth | 361/13 |
| 4,500,934 | 2/1985 | Kinsinger | 361/3 |

FOREIGN PATENT DOCUMENTS

| | | |
|---|---|---|
| 1072267 | 6/1967 | United Kingdom . |
| 1152903 | 5/1969 | United Kingdom . |

*Primary Examiner*—A. D. Pellinen
*Assistant Examiner*—Derek S. Jennings
*Attorney, Agent, or Firm*—Richard A. Menelly; Walter C. Bernkopf; Fred Jacob

[57] ABSTRACT

A gate turn-off thyristor is connected across a pair of separable contacts for diverting the interrupted current first to the thyristor and then to a metal oxide varistor connected across the thyristor. A saturable core current transformer in combination with the capacitance provided by the metal oxide varistor turns on the thyristor when the contacts separate and turns off the thyristor after the contacts have further separated when the core becomes saturated.

7 Claims, 1 Drawing Figure

GATE TURN-OFF CONTROL CIRCUIT FOR A SOLID STATE CIRCUIT INTERRUPTER

BACKGROUND OF THE INVENTION

The use of solid state circuits for eliminating contact arcing in circuit interruption devices has heretofore not proven economically feasible. When switchable circuit elements are employed, some complex additional circuitry is required to turn on the solid state circuit device to immediately divert current away from the separating contacts and then to transfer the current to a voltage controlled device, such as a metal oxide varistor.

The use of a silicon controlled rectifier for diverting current away from separating contacts is given within British Patent Specification No. 1,072,267. The use of a triac having a voltage dependent resistor connected across the gate circuit of the triac is disclosed British Patent Specification No. 1,152,903.

U.S. Pat. No. 3,783,305 describes a logic circuit connected to the control electrode of a thyristor for generating a trigger pulse to the thyristor upon contact separation.

U.S. Pat. No. 4,583,146 entitled "Fault Current Interrupter" in the name of E. K. Howell discloses the use of a positive temperature coefficient element and a varistor connected in parallel across separating contacts. The positive temperature coefficient element is capable of diverting current away from the contacts and over to the varistor by virtue of its temperature responsive properties.

U.S. patent application Ser. No. 681,478 filed Dec. 14, 1984 entitled "Circuit Interrupter Using Arc Commutation" in the name of E. K. Howell utilizes a zener diode in the gate circuit of a solid state switch to turn on the solid state switch when the arc voltage across a pair of separated contacts reaches a predetermined voltage. A capacitor connected in parallel with a varistor rapidly charges to the clamping voltage of the varistor to transfer the current to the varistor and away from the solide state switch.

U.S. patent application Ser. No. 610,947 filed May 16, 1984 entitled "Solid State Current Limiting Circuit Interrupter" utilizes a bi-polar power transistor to switch current away from separating contacts to a metal oxide varistor. The transistor is first turned on by a current pulse provided by a capacitor connected between the transistor collector and base. A saturable core current transformer in circuit with the transistor provides regenerative base drive for the transistor and the transistor turns off as soon as the transformer core becomes saturated. Also disclosed is the use of a field effect transistor, field controlled transistor and gate turn-off devices such as thyristors in place of the bi-polar power transistor.

The purpose of this invention is to provide a rapid means for transferring current from separating contacts to a metal oxide varistor in a short period of time and with a minimum amount of circuit components.

SUMMARY OF THE INVENTION

The invention comprises a gate turn-off-thyristor (GTO) across a pair of separable contacts to divert current from the contacts upon separation to virtually eliminate contact arcing. When the contacts are separated, the GTO is momentarily turned on and then turned off to transfer the current to a voltage clamping device, such as a varistor. The varistor is connected across the GTO and a saturable core current transformer is arranged in circuit with the GTO to advantageously control the on and off states of the GTO.

DESCRIPTION OF THE PREFERRED EMBODIMENT

Figure 1:
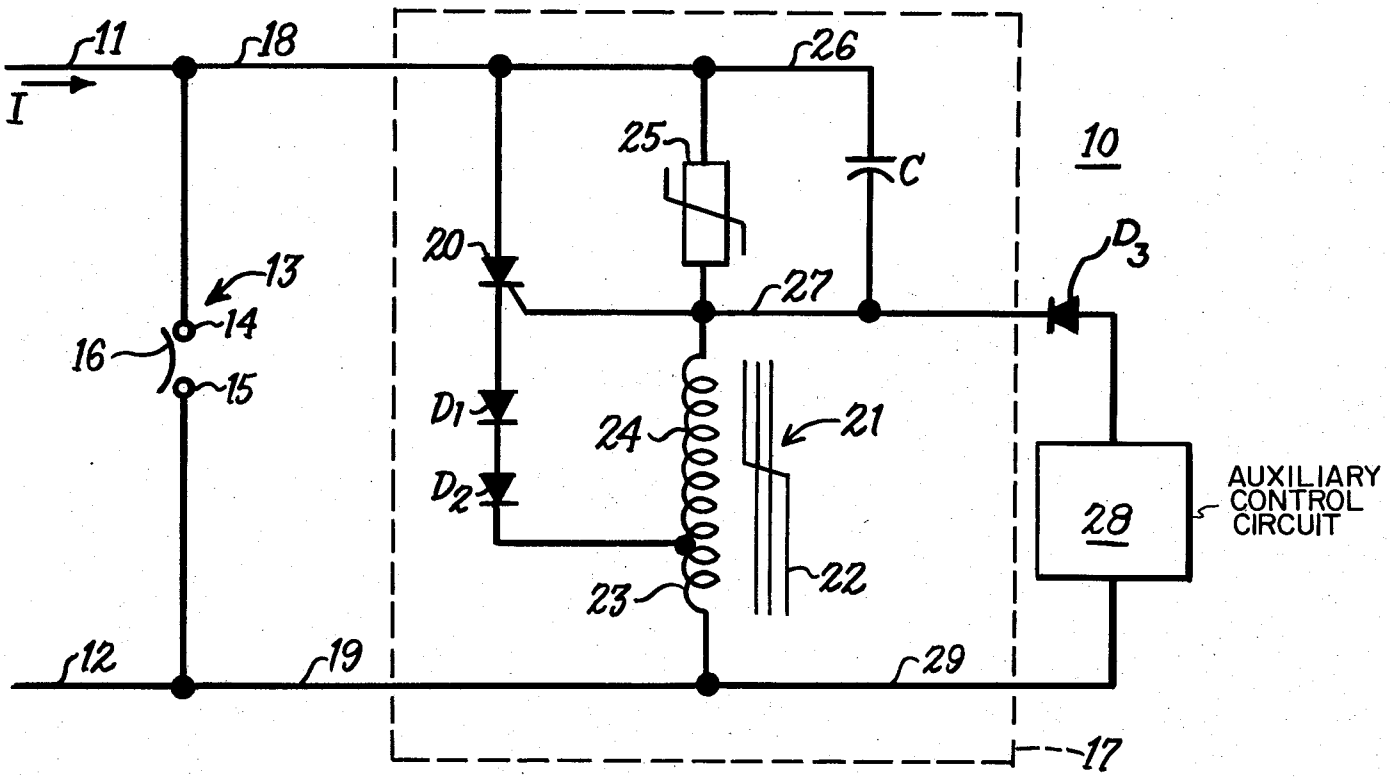
FIG. 1 is a schematic representation of the gate turn-off thyristor control circuit according to the invention.

The solid state circuit interrupter 10 shown in FIG. 1 finds application wherever arcless switching is required such as in an explosive atmosphere in mines, for example, and when "noise-free" switching is required such as within sensitive electronic instrumentation. A power bus consisting of conductors 11 and 12 contains a series switch 13 of the type consisting of a pair of fixed contacts 14, 15 and a movable bridging contact 16. When the circuit interrupter is to be used as a circuit protection device, a current sensor such as a current transformer and an operating mechanism such as described in U.S. Pat. No. 4,115,829 to E. K. Howell and U.S. Pat. No. 4,001,742 to C. L. Jencks et al. is employed to rapidly open the switch upon the occurrence of an overcurrent condition. A high speed contact driver such as described in U.S. patent application Ser. No. 684,307 filed Dec. 20, 1984 in the name of E. K. Howell, which is now abandoned, can be employed for moving the bridging contact 16 away from the fixed contacts 14, 15 when high speed circuit interruption and current limiting is desired. To promote such arcless interruption, a gate turn-off circuit 17 is connected across switch 13 by means of conductors 18 and 19. The gate turn-off circuit includes a 4-layer thyristor or a gate turn-off thyristor 20, hereafter GTO, and a metal oxide or silicon carbide varistor 25 connected across the anode and gate of the GTO. The cathode of the GTO is connected through a primary winding 23 of a current transformer 21 through a pair of fast recovery, low voltage diodes $D_1$ and $D_2$. The varistor 25 is connected in series with the secondary winding 24 and in common with the gate to the GTO. The transformer core 22 is selected to saturate at a predetemined value of current and time. With the switch contacts in the closed condition, the GTO remains in an off state and the current passes between the contacts 14 and 15. When the contacts are opened, a voltage is applied to the capacitor C arranged across the varistor resulting in a positive gate current over conductor 27 to turn on the GTO and to bypass current away from the contacts. For some circuit designs, the capacitor C can be eliminated and the capacitance tance inherent within the varistor itself is sufficient to turn on the GTO. Alternatively, varistor 25 may be connected from the conductor 18 to the cathode of the GTO, the cathode of $D_1$ or to the cathode of $D_2$ or to conductor 19. With some GTO designs, it is advantageous to convert the capacitor C from conductor 18 to the cathode of the GTO or to the cathode of $D_1$ or the cathode of $D_2$ for the purpose of limiting the rate of rise of voltage across the GTO, acting as a "snubber". When the GTO is turned on, the current then passes through the GTO and the diodes $D_1$ and $D_2$ through the primary winding 23. The current transformer continues to supply gate current to the GTO in a regenerative positive direction until the current transformer core 22 becomes saturated. At this time, the current transformer induced voltage collapses and a negative current flows out of the GTO gate driving the current transformer core further into saturation. The saturated impedance of the current transformer is designed such that all of the current can flow out of the GTO gate with a voltage drop less than the conduction voltages of the gate-cathode and diodes $D_1$,$D_2$ thereby causing the GTO to turn off. Once the GTO is turned off, current transfers to varistor 25 and the voltage across the varistor is the predetermined clamping voltage. Since the clamping voltage exceeds the system voltage, current quickly subsides and the voltage across switch 13 drops to systems voltage. For some applications an auxiliary control circuit 28 may be connected to the gate of the GTO through a diode $D_3$ over conductor 27 and to the current transformer primary winding over conductor 29. The control circuit 28 provides gate current to the GTO to turn on the GTO. Saturation of the transformer turns off the GTO by negative gate current. One example of a control circuit for providing controlled gate current is found within U.S. patent application Ser. No. 726,546 filed Apr. 24, 1985 in the names of T. E. Anderson et al. In most applications, the control circuit 28 can be dispensed with and the capacitive current through varistor 25 and/or capacitor C applied to transformer 21 is fully capable of providing the turn-on function and the turn-off function is provided by suitable design of the saturation characteristics of the transformer core 22.

It is thus been demonstrated that virtually arcless circuit interruption can be achieved by means of a gate turn-off control circuit whereby the circuit current is automatically transferred to a GTO as soon as the contacts become separated. The current is then transferred to a metal oxide varistor when the GTO gate is turned off wherein the current approaches zero when the stored energy in the system has been dissipated in the varistor.

Having described my invention, what I claim as new and desire to secure by Letters Patent is:

1. A circuit interrupter comprising:

a pair of separable contacts serially connected within an electric circuit;

a gated semiconductor device connected across said contacts for transferring circuit current away from said contacts upon separation; and control means in circuit with said gated semiconductor device for turning on said gated semiconductor device immediately upon separation of said contacts and for turning off said gated semiconductor device a predetermined time thereafter, said control means including a current transformer connected in series with said gated semiconductor device, a secondary winding of said current transformer being connected to the cathode and gate of said gated semiconductor device to provide regenerative gate current to said gate, said current transformer comprising a saturable core for interrupting said gate current to turn off said gated semiconductor after a predetermined time delay.

2. The circuit interrupter of claim 1 wherein said gated semiconductor device comprises a 4-layer thyristor.

3. The circuit interrupter of claim 1 including a voltage controlled device connected across said gated semiconductor device for providing a path for current when said gated semiconductors device is turned off and for limiting the voltage across said gated semiconductor device.

4. The circuit interrupter of claim 1 including a capacitive device connected across the anode and gate of said gated semiconductor device for providing a current to said gate upon separation of said contacts to thereby turn on said gated semiconductor device.

5. The circuit interrupter of claim 1 wherein said gated semiconductor device is connected across said contacts through at least one diode.

6. The circuit interrupter of claim 3 whereby said circuit current becomes transferred to said voltage controlled device after said predetermined time delay.

7. The circuit interrupter of claim 1 wherein said control means in circuit with said gated semiconductor device includes an auxiliary circuit for turning on said gated semiconductor device immediately upon separation of said contacts and for turning off said gated semiconductor device a predetermined time thereafter.

* * * * *